United States Patent [19]

Kulikowski et al.

[11] 4,077,543

[45] Mar. 7, 1978

[54] PROPELLANTLESS AEROSOL CONTAINER

[75] Inventors: Donald F. Kulikowski, Oak Forest, Ill.; Kenneth E. Richie, Maple Grove, Minn.; Peter N. Y. Pan, Country Club Hills, Ill.

[73] Assignee: Continental Can Company, Inc., New York, N.Y.

[21] Appl. No.: 770,248

[22] Filed: Feb. 18, 1977

[51] Int. Cl.[2] ..... B65D 35/28

[52] U.S. Cl. ..... 222/95

[58] Field of Search ..... 222/95, 340, 386.5; 221/227

[56] References Cited

U.S. PATENT DOCUMENTS

| | | | |
|---|---|---|---|
| 545,803 | 9/1895 | Klug | 221/227 X |
| 720,902 | 2/1903 | Du Beau | 222/95 |
| 1,716,981 | 6/1929 | Sacks | 222/95 |

*Primary Examiner*—Stanley H. Tollberg

*Attorney, Agent, or Firm*—John J. Kowalik; Joseph E. Kerwin; William A. Dittman

[57] ABSTRACT

A propellantless aerosol container wherein an elastic expelling member is sleeved over a flexible product containing member and carried within a rigid container body. Retainers, releasable from without the container, are provided whereby the expelling member may be extended and retained in the extended condition during filling of the container, and later released to provide an expelling force.

5 Claims, 8 Drawing Figures

PROPELLANTLESS AEROSOL CONTAINER

BACKGROUND AND SUMMARY OF THE INVENTION

The present invention relates to an improved product-dispensing container and to a method for preparing the same for filling.

Much concern has recently been shown over the possibly deleterious effects of fluorinated hydrocarbons upon the atmosphere. This concern has promoted the search for alternatives to the use of such materials to provide the expelling force in product-dispensing containers especially aerosol containers.

Among the proposed alternatives is the elastic bag concept, both with and without separate product-impervious liners. This concept is typified by Fowler et al, U.S. Pat. No. 3,981,415, wherein an elastomeric bag provides a contracting force on an inner, product-containing bag.

Unfortunately, use of such an expelling method presents problems associated with filling of the container in that energy must be stored in the bag by stretching the same, either prior to or during filling. Conventional filling equipment is incapable of extending the bag during the filling operation.

It is, therefore, a primary object of the present invention to provide a propellantless product-dispensing container which may be readily filled by conventional filling equipment. This is accomplished by a container wherein the elastic member is stretched prior to filling. More specifically, the elastic member is extended and releasably held in the extended state during the filling operation, whereby filling may be achieved at normal equipment operating pressure.

It is a further object to provide a propellantless product dispensing container as described above, which is simple and economical to produce. This is accomplished by a container wherein the elastic unit is extended to engagement with the base of the container body. Specifically, a projection is provided, on the bottom of the liner or the elastic unit, adapted to protrude through a passage in the container base. The projection is locked in this position by means releasable from without the container.

DESCRIPTION OF THE PREFERRED EMBODIMENT

Figure 1:
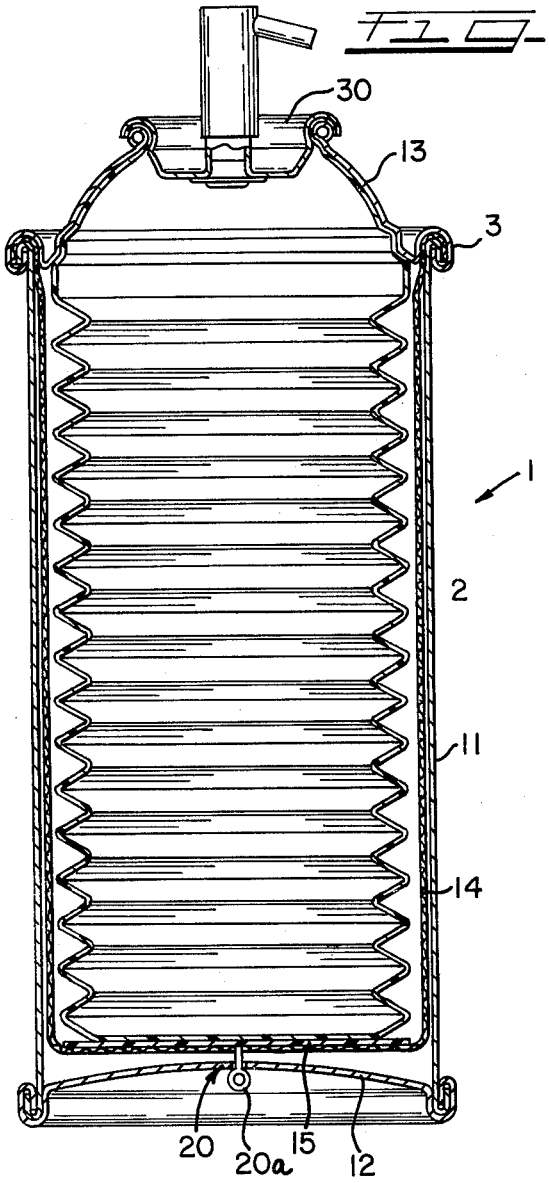
FIG. 1 is a side cross-sectional view of one embodiment of the present invention, illustrating the bag and the forcing means in the fully extended and locked condition.

The fluid-dispensing container of the present invention comprises a rigid container body 1, a volume-expansible product-containing member 2 disposed within the body 1 for receiving and holding the fluid, means for forcing the bag 2 to contract in volume so as to dispense the product therefrom, and means for restraining the forcing means from varying the volume of the product containing member 2.

The container body 1 includes a substantially cylindrical sidewall 11, a base 12, and a domed top 13, which are preferably formed of metal, although plastic material, cardboard, or the like may be suitable, especially for the sidewall 11. The base 12 which is formed slightly concave in the axially downward direction, is provided with a passage **12*b* therethrough, proximate the base center. The sidewall 11 and the base 12** may be integrally connected or they may be separate members joined by a conventional peripheral double-folded seam.

Figure 5:
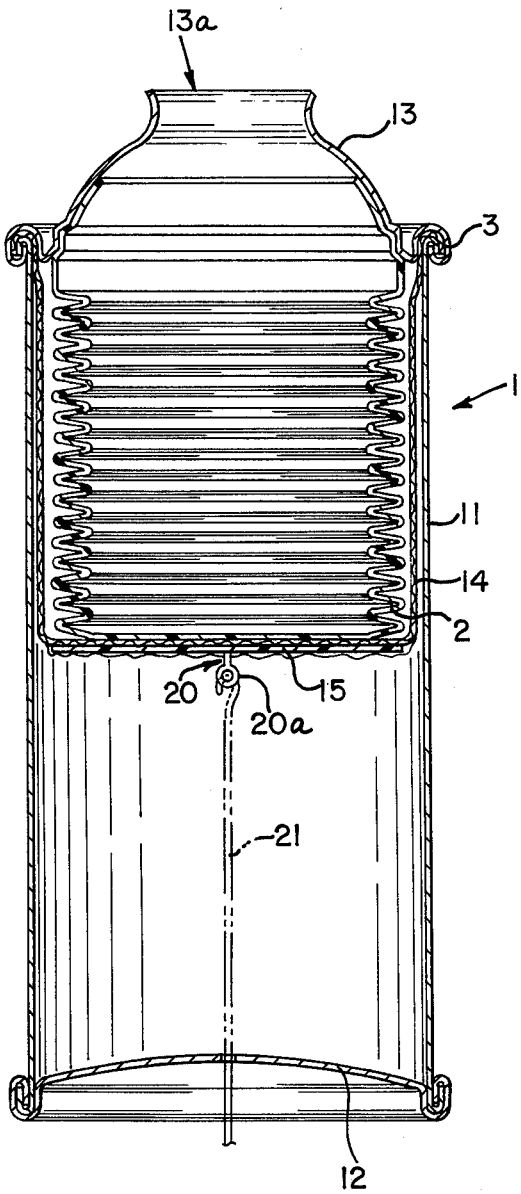
FIG. 5 is a side cross-sectional view similar to FIG. 1, illustrating the bag and forcing means in a partially extended condition.

The volume-expansible member 2, which may be of the axially collapsible, radially rigid type described in U.S. Pat. No. 3,828,977, is bonded to the inner surface of the domed top 13. A member 2 of this type is shown in FIGS. 1, 3 and 5. Alternatively, a radially collapsible member 2, of the type shown in FIG. 2, may be employed.

Product-dispensing force is provided by an extensible elastomeric member 14 which impresses an expelling force on the product-containing member 2. The member 2 is carried by the container body 1, with the open end of the member 14 caught or buried in double seam 3 joining the sidewall 11 and the top 13. The elastomeric member 14, which may be of the type disclosed in the previously mentioned U.S. Pat. No. 3,981,415, is arranged and adapted to provide a compressive force directed axially of the body 1 and substantially lacking in radial components. This is achieved through the utilization of a fabric having axially directed elastomeric fibers interwoven with inelastic circumferentially directed fibers.

Figure 2:
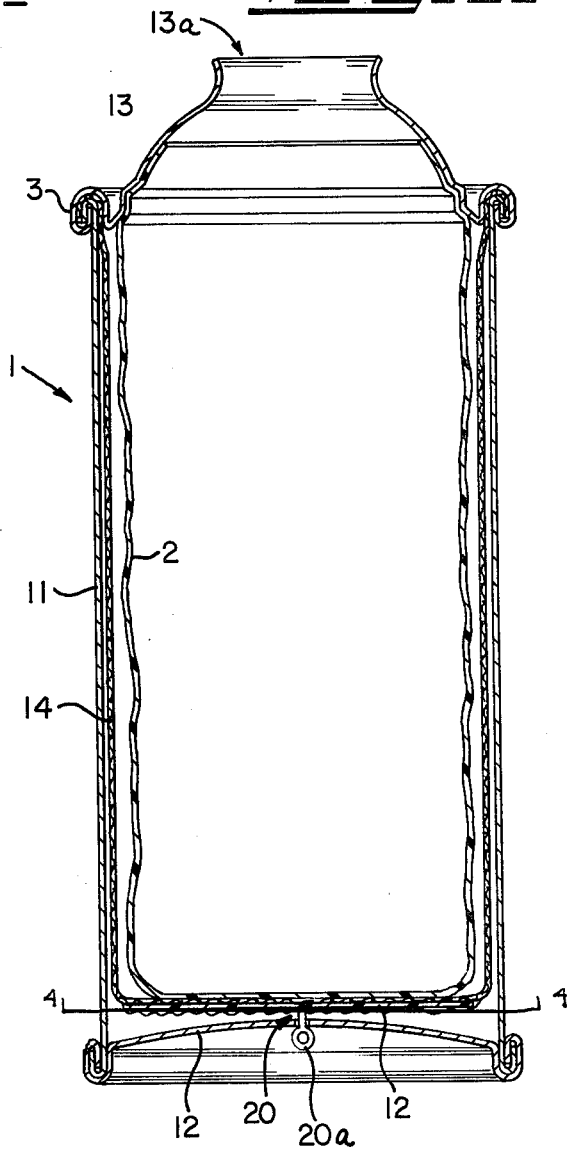
FIG. 2 is a side cross-sectional view similar to FIG. 1, illustrating an alternate embodiment of the invention.
Figure 3:
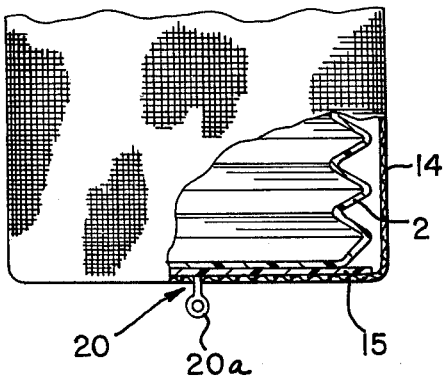
FIG. 3 is an enlarged cut-away view of a portion of the forcing means of the embodiment of FIG. 1, showing the rigidifying means attached thereto.
Figure 4:
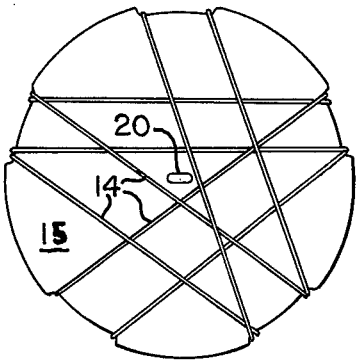
FIG. 4 is a cross-sectional view taken substantially along line 4—4 of FIG. 2, showing the rigidifying means attached to the forcing means.

A planar, rigid member 15, of a shape similar to the cross-section of the body is either inserted into the elastomeric member 14 (as shown in FIGS. 1 and 3) or attached to the exterior of the member 14, at the bottom thereof, by cords **14*a* (as shown in FIGS. 2 and 4) or other means. The rigid member 15 insures that the product-containing member 2 collapses in a controlled manner and that there is no product entrapment in the bag bottom. A downwardly directed projection 20, adapted to be readily gripped, is formed on the bottom of the rigid member 15**.

After assembly of the container, the product-containing member 2 and the enveloping elastomeric member 14 are elongated to the fully extended position as shown in FIGS. 1 and 2. This is preferably accomplished by reaching through the passage **12*b* in the container base 12 with a thin member 21, grasping the projection 20, and pulling the rigid member 15 toward the base 12 (FIG. 5**).

When the member 2 and elastomeric member 14 are in the fully extended position, the projection 20 is locked in position protruding through the passage **12*b*** by means releasable from without the container.

Figure 6:
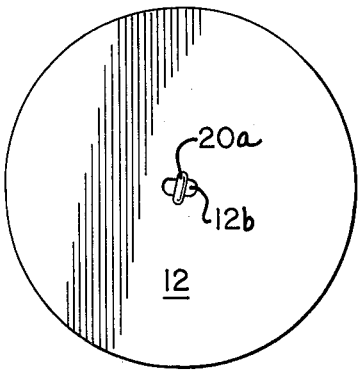
FIG. 6 is a bottom plan view of the container of the present invention, illustrating apparatus for retaining the forcing means in the extended position.
Figure 7:
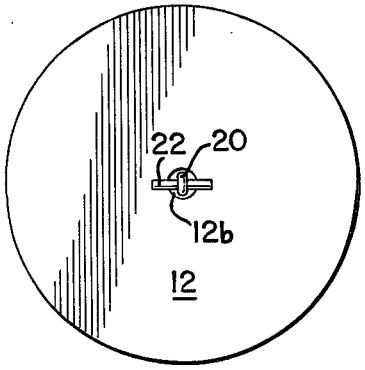
FIG. 7 is a bottom plan view similar to FIG. 6, illustrating another retaining apparatus.
Figure 8:
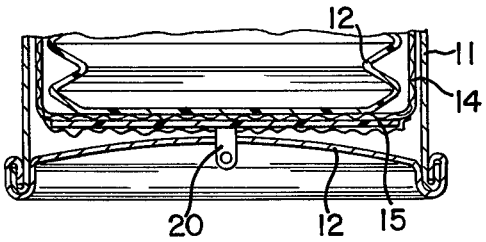
FIG. 8 is a fragmentary cross-sectional view illustrating yet another retaining apparatus.

The projection 20 may be locked or retained in the extended state by inserting a rod 22 through a hook or eyelet 20*a* formed in the distal end of the projection 20, the rod 22 being of a length too great to pass through the passage 12*b* (FIG. 7). Alternatively, an elongated passage 12*b* may be employed, whereby locking may be achieved by passing the curved portion of the projection 20 through the passage 12*b* and then rotating the projection 20 to move the longitudinal axes of the projection 20 and passage 12*b* out of alignment (FIG. 6). It is also contemplated that locking may be accomplished by interference between the projection 20 and the sides of the passage 12*b* (FIG. 8).

With the member 2 and elastomeric member 14 locked in the extended state, the container may be filled through opening 13*a* in the top 13, by conventional filling equipment operating at normal filling pressures.

After filling, a valve assembly 30 is inserted in the opening 13*a* and sealed in position by means well known in the art. The projection 20 is now unlocked, releasing the elastomeric member 14 which thereupon impresses an expelling force on the product-containing member 2.

We claim:

1. A propellantless product dispensing container prepared for filling, comprising a rigid container body including a side-wall, a base, and upper portion, a flexible container member carried within said body for receiving and holding said product, and elastomeric means for forcing said flexible container member to contract in volume to dispense said product therefrom, said elastomeric forcing means being releasably tensioned between said body base and said upper portion from without said container body and being releasable to impress a dispensing force on said flexible container member.

2. A propellantless product dispensing container prepared for filling, comprising a rigid container body including a side-wall and a base, a flexible container member carried within said body for receiving and holding said product, and elastomeric means for forcing said flexible container member to contract in volume to dispense said product therefrom, said elastomeric forcing means being attached to said body base in a stressed state and releasable, from without said container body to impress a dispensing force on said flexible container member, said forcing means comprising an elastomeric member attached to the interior of said body and sleeved over said flexible container

3. The container of claim 2, wherein said flexible container member has an open end and a closed end, and there is provided rigidifying means on one of said flexible container member and said forcing means, said rigidifying means maintaining said closed end of said flexible container member in a substantially planar configuration.

4. The container of claim 3, where said base has a passage therethrough, and one of said flexible container member, said elastomeric member and said rigidifying means includes a projection adapted to protrude through said passage from the interior of said body.

5. The container of claim 4, and means releasable from without said container body preventing withdrawal of said projection through said passage.

* * * * *